United States Patent [19]

Tlach et al.

[11] 4,299,654

[45] Nov. 10, 1981

[54] PROCESS FOR PRODUCING SIZED PAPER AND CARDBOARD WITH POLYELECTROLYTES AND EPOXIDE-AMINE-POLYAMIDE REACTION PRODUCTS

[75] Inventors: Hugo Tlach, Basel; Klaus-Dieter Leifels, Binningen; Werner Mischler, Burg, all of Switzerland

[73] Assignee: Ciba-Geigy Corporation, Ardsley, N.Y.

[21] Appl. No.: 108,610

[22] Filed: Dec. 31, 1979

Related U.S. Application Data

[63] Continuation of Ser. No. 933,689, Aug. 15, 1978, abandoned.

[30] Foreign Application Priority Data

Aug. 26, 1977 [CH] Switzerland ..... 10455/77

[51] Int. Cl.[3] ..... D21H 3/58

[52] U.S. Cl. ..... 162/164 EP; 162/167; 162/168 NA; 162/174; 162/175; 162/178; 162/183

[58] Field of Search ..... 162/164 EP, 168 NA, 162/164 R, 175, 178, 166, 167, 174, 183

[56] References Cited

U.S. PATENT DOCUMENTS 3,392,085 7/1968 Oliver ..... 162/178

3,709,847 1/1973 Toepfl et al. ..... 260/18 PN

FOREIGN PATENT DOCUMENTS 49-24162 6/1974 Japan ..... 162/168 NA

*Primary Examiner*—William F. Smith

*Attorney, Agent, or Firm*—Edward McC. Roberts

[57] ABSTRACT

A process for producing paper or cardboard sized in the pulp with epoxide-amine-polyamide reaction products is disclosed.

This process comprises adding to the fibre suspension, which has a pH value of 5 to 8, (A) at least one water-soluble higher molecular polyelectrolyte, which is cationic if the pH value of the fibre suspension is 6.5 to 8 and anionic if the pH value of the fibre suspension is 5 to 7, followed by (B) at least one water-soluble or water-dispersible salt of an epoxide-amine-polyamide reaction product, and further processing the fibre suspension into the form of paper or cardboard.

8 Claims, No Drawings

PROCESS FOR PRODUCING SIZED PAPER AND CARDBOARD WITH POLYELECTROLYTES AND EPOXIDE-AMINE-POLYAMIDE REACTION PRODUCTS

This is a continuation of application Ser. No. 933,689 filed on Aug. 15, 1978, now abandoned.

The present invention relates to a process for producing paper or cardboard sized in the pulp with epoxide-amine-polyamide reaction products, which process comprises adding to the fibre suspension, which has a pH value of 5 to 8, (A) at least one water-soluble higher molecular polyelectrolyte, which is cationic if the pH value of the fibre suspension is 6.5 to 8 and anionic if the pH value of the fibre suspension is 5 to 7, followed by (B) at least one water-soluble or water-dispersible salt of an epoxide-amine-polyamide reaction product, and further processing the fibre suspension into the form of paper or cardboard.

The addition of polyelectrolytes, for example alginates or epoxide-amine-polyamide reaction products, to the fibre suspension in the manufacture of paper is known. It has now been found that, with the addition of polyelectrolytes to the fibre suspension, an addition of epoxide-amine-polyamide reaction products subsequent to the introduction of the polyelectrolyte results in a surprising synergistic enhancement of the sizing effects of the polyelectrolyte and of the epoxide-amine-polyamide reaction product.

In the process according to the invention, a pH value of the fibre suspension of 6.5 to 7 is particularly preferred because in this pH range both cationic and anionic polyelectrolytes can be used as component (A).

As component (A) are used however as a rule cationic polyelectrolytes with pH values of the fibre suspension of 7 to 8, and anionic polyelectrolytes with pH values of the fibre suspension of 5 to less than 7.

The polyelectrolytes used as component (A) in the process according to the invention are both of natural and of synthetic origin. In the case of the polyelectrolytes of natural origin, these are for example fine guar flour or locust bean flour containing carbohydrates having a molecular weight preferably of 250,000 to 350,000, or especially esters or salts of alginic acid having molecular weights preferably of 100,000 to 240,000. The salts of alginic acid assume in this connection particularly great importance. This is also the case with respect to starches of natural origin, for example maize starch and potato starch which are cationically modified, or with respect to cationically modified carbohydrates from fine guar flour having molecular weights of 250,000 to 350,000. The polyelectrolytes of synthetic origin are for example polycondensation products from naphthalenesulphonic acid and formaldehyde, polycondensation products of the acrylic acid series, or preferably epihalohydrine adducts of reaction products from polyalkylenepolyamines and polyfunctional compounds. Also condensation products from cyanamides, formaldehyde and ammonium salts are preferred polyelectrolytes of synthetic origin.

As examples of preferred cationic polyelectrolytes which are added as component (A) to neutral to weakly alkaline fibre suspensions, the pH value of which is 6.5 to 8.0 or 7 to 8, there may be mentioned the following polymerisates in the sequence to which they are preferred:

epichlorohydrin adducts of reaction products from polyalkylenepolyamines and aliphatic dicarboxylic acids such as are described, inter alia, in the British Patent Specification No. 865,727;

epichlorohydrin adducts of reaction products from polyalkylenepolyamines, dicyandiamide or cyanamide, and optionally from dicarboxylic acids which are unesterified or esterified with alkanols, preferably epichlorohydrin adducts of reaction products from diethylenetriamine, dicyandiamide and dimethyladipate, such as are described, inter alia, in the British Patent Specification No. 1,125,486;

condensation products from cyanamides, formaldehyde and ammonium salts, preferably from cyanamide and in particular dicyanamide, formaldehyde and an ammonium halide, for example ammonium chloride, especially the condensation product from 1 mol of dicyanamide, 2.3 mols of formaldehyde and 1.3 mols of ammonium chloride;

cationic polycondensation products of the acrylic acid series, particularly a cationic polyacrylic amide of which the density is about 1000 kg/m$^3$, the dynamic viscosity at 20° C. 5000 to 7000 mPa.s (Brookfield, spindle 4, 20 rpm) and the pH value 4;

cationically modified alginic acid, such as quaternary ammonium salts or acid salts of an amine-modified alginic acid, with this cationically modified alginic acid having a degree of polymerisation preferably of 800 to 1200;

cationically modified galactomannan from fine guar flour which has a substitution degree of 0.10 to 0.15 and a nitrogen content of 1.2 to 1.8 percent by weight, and which is modified in particular with 2,3-epoxy-n-propyl-1-trimethylammonium chloride; and cationically modified maize starch or potato starch which is modified with a propylene oxide containing quaternary ammonium groups, and which has, as a 25% dispersion in distilled water at 20° C., a pH value of 4.2 to 4.6.

As examples of preferred anionic polyelectrolytes which are added as component (A) to the weakly acid fibre suspensions, the pH value of which is 5 to 7 or 5 to less than 7, especially 5 to 6, there may be mentioned the following polymerisates in the sequence in which they are preferred:

dimerised condensation products from naphthalenesulphonic acids and formaldehyde;

copolymers from acrylic acid and acrylic amide; and alkali metal salts or ammonium salts of alginic acid, with sodium alginates having a degree of polymerisation preferably of 800 to 1200 being of particular importance.

In the process according to the invention is added as a rule, to the fibre suspension, 0.01 to 1, preferably 0.02 to 0.8, particularly 0.05 to 0.4, percent by weight of the aforementioned polyelectrolytes as component (A), calculated as anhydrous polymer, relative to the dry-fibre content of the fibre suspension.

As preferred component (B) are used salts of epoxide-amine-polyamide reaction products from (a) 1.0 epoxide group equivalent of a polyglycidyl ether of 2,2-bis-(4'-hydroxyphenyl)-propane, (b) 0.4 to 0.6 amino group equivalent of at least one mono-fatty amine having 16 to 18 carbon atoms, and (c) 0.3 to 0.5 amino group equivalent of a polyalkyleneaminopolyamide from
(c') polymerised linoleic and/or linolenic acid, and
(c'') diethylenetriamine, triethylenetetramine or tetraethylenepentamine, these salts of the reaction products being in the form of aqueous preparations having a solids content of 25 to 35 percent by weight and a pH value of 4 to 5. As component (B) are used in particular salts of epoxide-amine-polyamide reaction products which are produced in at least one solvent chemically inert to the components (a), (b) and (c). Suitable inert solvents are, inter alia, aliphatic ethers or especially alcohols having 1 to 10 carbon atoms, such as dioxane, methylene glycol-n-butyl ether (=n-butyl glycol), diethylene glycol monobutyl ether, and alkanols having 1 to 4 carbon atoms, especially isopropanol, ethanol or methanol, all soluble in water in any proportion.

The salts of component (B) are preferably used as aqueous preparations which have a pH value of 4 to 5, especially 4 to 4.5, and which are adjusted to this pH value with inorganic or, in particular, organic acids which are preferably volatile. These acids are particularly alkanecarboxylic acids having 1 to 4, preferably 1 or 2, carbon atoms, i.e. formic acid and especially acetic acid.

The epoxide-amine-polyamide reaction products used as component (B) in the process according to the invention are preferably produced from a polyglycidyl ether as component (a), which has a preferred epoxide content of 5 to 5.5 equivalents per kg, a mono-fatty amine as component (b) and a polyalkyleneaminopolyamide as component (c), each of (b) and (c) having preferred amino group contents of 3 to 4 equivalents per kg. Especially suitable components (B) are salts of reaction products, which salts are produced from an adduct of epichlorohydrin and 2,2-bis-(4'-hydroxyphenyl)-propane as component (a), tallow fatty amine as component (b) and a polyamide from dimerised linoleic acid as component (c') and triethylenetetramine as component (c'').

The salts of epoxide-amine-polyamide reaction products, which salts are used as component (B) in the process according to the invention, are described, inter alia, in the Swiss Patent Application No. 15764/76 or in the British Patent Specification No. 1,300,505.

In the process according to the invention is added to the fibre suspension as a rule 0.1 to 3, preferably 0.2 to 0.8, percent by weight of component (B), calculated as anhydrous salt of the epoxide-amine-polyamide reaction product, relative to the dry-fibre weight of the fibre suspension.

In the process according to the invention, there is firstly added to the fibre suspension the component (A) and then the component (B), the addition of component (A) being made 8 to 210, preferably 8 to 80, especially 10 to 55, seconds before reaching the breastbox of the paper machine, and the addition of component (B) being made 3 to 50, preferably 5 to 45, particularly 10 to 25 seconds before reaching the breastbox, however at least 5, preferably 10 to 120, and especially 10 to 40 or 10 to 30 seconds, after the addition of component (A).

The fibre suspension, to which the components (A) and (B) are added, has as a rule a dry-fibre content of 0.1 to 5, preferably 0.3 to 3, especially 0.3 to 1, percent by weight, and a Schopper-Riegler freeness value of 20° to 60°, preferably 20° to 45°, particularly 25° to 35°, and contains as a rule sulfite pulp (sulfite cellulose), particularly sulfite pulp from conifers, sulfate pulp, especially sulfate pulp from beechwood, and optionally bleached mechanical wood pulp.

The fibre suspension can furthermore contain organic or mineral fillers. Suitable organic fillers are, inter alia, synthetic pigments, for example polycondensation products from urea or melamine and formaldehyde which have large specific surface areas, which are in a highly dispersed form and which are described, inter alia, in the British Patent Specifications Nos. 1,043,937 and 1,318,244; and suitable mineral fillers are, inter alia, talcum, titanium dioxide and, in particular, kaolin and/or calcium carbonate. The fibre suspension contains as a rule 0 to 40, preferably 5 to 25, especially 15 to 20, percent by weight, relative to the dry-fibre weight, of fillers of the stated type.

With the addition of, for example, calcium carbonate, weakly alkaline fibre suspensions having a pH value of above 7 to not more than 8 are obtained. Weakly acid fibre suspensions having a pH value of 5 to less than 7, or 5 to 7, especially 5 to 6, can be obtained by addition of, for example, sulfuric or formic acid, or in particular by addition of for example latently acid sulfates, such as aluminium sulfate.

The fibre suspension can also contain additives, for example starch or degradation products thereof, which increase the bond from fibre to fibre or the fibre/filler bond.

In the process according to the invention, the fibre suspension is further processed, in a manner known per se, on sheet forming apparatus, or preferably continuously on paper machines of customary design, into the form of paper or cardboard. Paper or cardboard produced by the process according to the invention thus constitutes further subject matter of the present invention.

Parts and percentages given in the following manufacturing instructions and practical examples are parts by weight and percentages by weight.

Manufacturing instructions for salts of epoxide-amine-polyamide reaction products [component (B)]

A. 190 Parts (1 epoxide equivalent) of an epoxide (epoxide number: 5.26 equivalents/kg) formed from 2,2-bis-(4'-hydroxyphenyl)-propane and epichlorohydrin, 68 parts of methanol and 108 parts of stearylamine (0.4 amino group equivalent) are heated to an internal temperature of 68° C. and held for 15 minutes at this temperature. To this solution is added within 30 minutes a solution of 125 parts (0.5 amino group equivalent) of a polyamide from dimerised linoleic acid and diethylene triamine in 125 parts of methanol. After a reaction time of five hours at 65° C., a solution of 75 parts of acetic acid in 250 parts of water is added to the reaction mixture to yield a clear solution, which is then diluted with water to give a solids content of 30%. The pH value of the diluted solution is 4.5.

B. 135 Parts (0.5 amino group equivalent) of tallow-fatty amine (30% of $C_{16}H_{33}NH_2$, 30% of $C_{18}H_{37}NH_2$ and 40% of $C_{18}H_{35}NH_2$, amine number: 3.7 equivalents/kg) and 38 parts of isopropanol are heated to 85° C. To this solution is then added at 85° C. a solution of 190 parts (1 epoxide group equivalent) of an epoxide (epoxide number: 5.26 equivalents/kg), which is formed from 2,2-bis-(4'-hydroxyphenyl)-propane and epichlorohydrin, in 38 parts of isopropanol. The reaction mixture is maintained at 85° C. for 15 minutes. There is obtained a clear 81% solution, of which the amine-epoxide reaction product has an epoxide group equivalent weight of 3120.

To this reaction solution is added a solution of 108 parts (0.432 amino group equivalent) of a polyamide from dimerised linoleic acid and triethylenetetramine in 38 parts of isopropanol. After two hours' reaction at 85° C., there is added to the reaction mixture a solution of 72 parts of acetic acid in 227 parts of water. There is obtained a clear solution which is diluted with water to give a solids content of 30%. The pH value of the diluted solution is 4.

C. 135 Parts (0.5 amino group equivalent) of stearylamine and 40 parts of ethylene glycol monobutyl ether are heated to 80° C. There is then added a solution of 190 parts (1 epoxide group equivalent) of an epoxide (epoxide number: 5.26 equivalents/kg), which is formed from 2,2-bis-(4'-hydroxyphenyl)-propane and epichlorohydrin, in 40 parts of ethylene glycol monobutyl ether at 80° C. The reaction mixture is held at 85° C. for 15 minutes. To this reaction solution is added a solution of 125 parts (0.5 amino group equivalent) of a polyamide from dimerised linoleic acid and triethylenetetramine in 100 parts of ethylene glycol monobutyl ether. After a reaction time of two hours at 85° C., there is added to the reaction mixture a solution of 83 parts of acetic acid in 230 parts of water to thus obtain a clear solution which is diluted with water to give a solids content of 30%. The pH value of the diluted solution is 4.6.

EXAMPLE 1

15% of kaolin is added to a fibre suspension of

55% of a bleached sulfite pulp,
20% of a bleached beechwood sulfate pulp, and
25% of a bleached mechanical wood pulp, which suspension has a dry-fibre content of 3% and a Schopper-Riegler freeness value of 35°, the kaolin being added in the form of an 18% aqueous suspension. After the addition of kaolin, the fibre suspension has a pH value of 6.8. To this fibre suspension is added, as a 12% aqueous solution, 0.1% of a condensation product from 6 mols of diethylenetriamine, 1 mol of dicyandiamide, 5 mols of dimethyladipate and 9 mols of epichlorohydrin. Ten seconds after the addition of this condensation product, there is also added to the fibre suspension 0.65% of the salt of the epoxide-amine-polyamide reaction product according to manufacturing instruction A, as a 0.33% aqueous solution. Ten seconds after the addition of the salt, the fibre suspension is processed in a laboratory sheet forming apparatus into paper having a weight per unit area of 80 g/m$^2$.

The stated percentages for kaolin, for the aforementioned condensation product and for the salt of the reaction product according to instruction A apply to anhydrous products, relative to the dry-fibre content of the fibre suspension.

The paper produced in the laboratory sheet-forming apparatus is tested with respect to the ink flotation time (IFT) on a test ink according to DIN 53126 using the following method.

Paper test ink "blue", according to DIN 53126, is poured into a 10×12 cm porcelain dish until the level of the ink has reached 0.5 cm. The paper to be tested is folded to form little boats having an upright edge (size 4×4 cm). The boats are placed by means of tweezers onto the surface of the ink. A stop watch is simultaneously released, and the time until a visible strike-through of the test ink occurs is measured. The results are recorded in seconds.

In the case of untreated paper, the strike-through of the ink occurs immediately. The longer the test ink takes to strike through the sized paper, the better is the sizing.

The paper produced according to the invention, with addition to the fibre suspension both of the aforementioned condensation product and of the salt of the reaction product according to instruction A gives an IFT of 255 seconds. If however the paper is produced from a fibre suspension containing merely the salt of the reaction product according to instruction A, the paper gives an IFT of only 100 seconds.

EXAMPLE 2

The procedure as given in Example 1 is followed except that there is used a fibre suspension comprising 35% of bleached sulfite pulp,
10% of bleached beechwood sulfate pulp, and
35% of bleached mechanical wood pulp.

To this fibre suspension is added, as in Example 1, 15% of kaolin. After the addition of kaolin, the pH value of the fibre suspension is 6.8. The suspension gives a Schopper-Riegler freeness value of 35° and has a dry-fibre content of 3%. Ten seconds after the addition of 0.1% of the condensation product of the composition given in Example 1, there is added to the fibre suspension 0.77% of the salt of the epoxide-amine-polyamide reaction product according to manufacturing instruction C as a 0.33% aqueous solution. Ten seconds after addition of the salt, the fibre suspension is processed, as described in Example 1, into the form of paper, which is tested with respect to the ink flotation time (IFT) obtained therewith.

The paper produced according to the invention gives an IFT of 255 seconds. If however the paper is produced from a fibre suspension containing merely the salt according to instruction C, the paper gives an IFT of only 190 seconds.

EXAMPLE 3

A fibre suspension of

80% of bleached sulfite pulp and
20% of bleached sulfate pulp, which contains 1.4% of oxidatively hydrolysed, dissolved starch, and which has been adjusted with aluminium sulfate to a pH value of 5.8 before being ground in the pulper, is beaten in a conical refiner from an initial Schopper-Riegler freeness value of 16° to 32°; it is subsequently diluted with the white water II of the paper machine to a dry-fibre content of 0.9%, and 16% of kaolin as a 50% aqueous suspension is continuously added. The pH value of the fibre suspension after the addition of kaolin is 5.9. To this fibre suspension is then continuously added, by means of a piston dosing pump, 0.05% of sodium alginate which has a degree of polymerisation of 800 to 1200 and which is in the form of an aqueous solution having a concentration of 9 g/l. Fifteen seconds after the addition of the sodium alginate, there is further added to the fibre suspension, likewise continuously by means of a piston pump, 0.46% of the salt of the epoxide-amine-polyamide reaction product according to manufacturing instruction B, in the form of a 3.3% aqueous solution.

The given percentages for kaolin, sodium alginate and the salt of the reaction product apply to anhydrous products, relative to the solids content of the fibre suspension.

Ten seconds after the addition of the salt of the reaction product, the fibre suspension reaches the cleaner of the breastbox of an endless wire paper making machine having a working width of 3.2 meters and a sieving rate of 217 m/minute, in which the fibre suspension is processed into an offset paper having a weight per unit area of 100 g/m$^2$.

The paper procedure according to the invention has an ink flotation time (IFT) of 780 seconds; furthermore, the writing properties of the paper are verified in that 0.8 mm thick strokes of the pen with the blue paper-test ink according to DIN 53126, which are applied with a drawing device and a double-pointed drawing pen to the paper being tested, do not strike through or spread out.

On the other hand, a paper which has been produced in the same machine and from the same fibre suspension but without addition of sodium alginate to the fibre suspension gives an IFT of only 210 seconds, and has inadequate writing properties, with the result that the stroke of the pen with the test ink readily spreads.

EXAMPLE 4

The pH of a fibre suspension of

50% of bleached sulfite pulp and
50% of bleached sulfate pulp, which gives a Schopper-Riegler freeness value of 33°, is adjusted, in a mixing vat, with a 15% aqueous aluminium sulfate suspension to the value given in the following Table I, and 20% of kaolin as a 30% aqueous suspension is added. The percentage value for kaolin is with respect to the anhydrous product, relative to the dry-fibre content of the fibre suspension. After the kaolin addition, there is established in the fibre suspension a pH value which is likewise given in the following Table I.

The fibre suspension is continuously diluted with water to give a dry-fibre content of 0.8%. There are then added to the fibre suspension, 50 seconds before reaching the breastbox of the paper machine, the amounts shown in the following Table I (as % amount of anhydrous product relative to the dry-fibre content of the fibre suspension) of a sodium alginate having a degree of polymerisation of 800 to 1200. Before being used, the sodium alginate is dissolved in water at 90° C. in a weight ration of 1:2,600. Twenty-five seconds before the fibre suspension reaches the breastbox of the paper machine, there is continuously added the amount likewise shown in the following Table I (as % of anhydrous product, relative to the dry-fibre content of the fibre suspension) of the salt of the epoxide-amine-polyamide reaction product according to manufacturing instruction B, in the form of a 3.3% aqueous solution.

The fibre suspension is processed in a laboratory paper machine, with constant adjustment of the machine, into a paper having a weight per unit area of 75±2 g/m$^2$. The paper is dried in the machine to the extent that the paper has a residual moisture content of 5%. The paper sheets obtained are conditioned for 24 hours with 65% relative humidity, and then tested for their IFT as described in Example 1. Also measured is the water absorption according to Cobb with 30 seconds duration of action (WA Cobb$_{30}$) according to DIN 53132. The less the water absorption, the better is the sizing of the paper. The results of the IFT and WA Cobb$_{30}$ tests are likewise summarised in the following Table I.

TABLE I

| Example No. | pH-Value of the fibre suspension after the addition of aluminum sulfate | pH-Value of the fibre suspension after the addition of kaolin | % of sodium alginate | % of salt of the reaction product | IFT seconds | WA Cobb$_{30}$ g/m$^2$ |
|---|---|---|---|---|---|---|
| 4a | 5.0 | 5.8 | 0.105 | 0.41 | 170 | 42 |
| 4b | 6.0 | 6.95 | 0.102 | 0.46 | 210 | 33 |
| (comparison) | 5.0 | 5.8 | 0 | 0.42 | 22 | 76 |
| (comparison) | 6.0 | 6.95 | 0 | 0.44 | 60 | 74 |

EXAMPLE 5

To a fibre suspension consisting of

50% of bleached sulfite pulp and
50% of bleached sulfate pulp, which gives a Schopper-Riegler freeness value of 32°, is added, in a mixing vat, 20% of precipitated calcium carbonate as a 30% aqueous suspension. The pH value in the fibre suspension after the addition of calcium carbonate is 7.4 to 7.5. The fibre suspension is continuously diluted with water to give a dry-fibre content of 0.8%. The subsequent procedure is carried out as described in Example 4 except that to the fibre suspension is added, 50 seconds before it reaches the breastbox of the paper machine, a cationically amine-modified alginic acid having a degree of polymerisation of 800 to 1200, in place of the sodium alginate. In this case too, in the manner mentioned in Example 4, the modified alginic acid is diluted, before its addition to the fibre suspension, with water at 90° C. in a weight ratio of 1:2,600. The salt of the epoxide-amine-polyamide reaction product according to instruction B is added as a 3.3% aqueous solution 25 seconds before the fibre suspension reached the breastbox of the paper machine. The percentage values for the amounts (given in the Table II which follows) of cationically modified alginic acid and of salt according to instruction B likewise apply to anhydrous products, relative to the dry-fibre content of the fibre suspension.

The fibre suspension is processed into paper in the way described in Example 4. The paper thus produced is likewise conditioned and then tested with respect to its IFT and WA $Cobb_{30}$, with the results of these tests being summarised in the Table II which follows.

TABLE II

| Example No. | % of cationically modified alginic acid | Salt of the reaction product in % | IFT sec. | WA $Cobb_{30}$ g/m$^2$ |
|---|---|---|---|---|
| 5a | 0.2 | 0.45 | 325 | 38 |
| 5b | 0.1 | 0.44 | 250 | 41 |
| (comparison) | 0 | 0.43 | 210 | 71 |

EXAMPLE 6

To the diluted fibre suspension according to Example 5 is added, 50 seconds before it reaches the breastbox of the paper machine, the amounts, given in the following Table III (as % amount of anhydrous product, relative to the dry-fibre content), of a galactomannan from guar flour, which is cationically modified with 2,3-epoxy-n-propyl-1-trimethylammonium chloride, and which has a substitution degree of 0.10 to 0.15 and a nitrogen content of 1.2 to 1.8%. Before being used, the galactomann is dissolved with water at 90° C. in a weight ration of 1:2,600. Twenty-five seconds before the fibre suspension reached the breastbox of the paper machine, there is added continuously the amount, likewise given in the following Table III (as % amount of anhydrous product, relative to the dry-fibre content of the fibre suspension), of the salt of the epoxide-amine-polyamide reaction product according to manufacturing instruction B, in the form of a 3.3% aqueous solution.

The fibre suspension is processed to paper in the manner described in Example 4. The paper thus produced is likewise conditioned, in the way given in Example 4, and then tested with respect to its IFT and WA $Cobb_{30}$, and the results of these tests are likewise summarised in the Table III which follows.

TABLE III

| Example No. | % amount of cationically modified galactomannan from guard flour | % amount of salt of the reaction product according to Instruction B | IFT sec. | WA $Cobb_{30}$ g/m$^2$ |
|---|---|---|---|---|
| 5a | 0.2 | 0.45 | 320 | 38 |
| 5b | 0.1 | 0.44 | 280 | 42 |
| (comparison) | 0 | 0.43 | 200 | 70 |

EXAMPLE 7

To a fibre suspension consisting of

50% of bleached sulfite pulp from conifers, and
50% of bleached sulfate pulp from beechwood, which gives a Schopper-Riegler freeness value of 38°, is added, in a mixing vat, 15% of precipitated calcium carbonate as a 30% aqueous suspension. The pH value in the fibre suspension after the addition of the calcium carbonate is 7.2 to 7.6. The fibre suspension is continuously diluted to obtain a dry-fibre content of 0.3%. To the fibre suspension are then added, 15 seconds before the suspension reaches the breastbox of the paper machine the amounts, given in the following Table IV (as % amounts of anhydrous product, relative to the dry-fibre content of the fibre suspension), of a maize starch cationically modified with a propylene oxide containing quaternary ammonium groups (pH of the 25% suspension is distilled water at 20° C.: 4.2 to 4.6). Before being used, the cation-active maize starch is hydrolysed with water at 90° to 96° C. for 20 to 30 minutes, and diluted to give a 1% solution with water at 90° C. There is then continuously added, 5 seconds before the fibre suspension has reached the breastbox of the paper machine, the amount, likewise given in the following Table IV (as % amount of anhydrous product, relative to the dry-fibre content of the fibre suspension), of the salt of the epoxide-amine-polyamide reaction product according to manufacturing instruction B, in the form of a 2% aqueous solution.

The fibre suspension is subsequently processed into paper as described in Example 4, and the water absorption of the paper is measured according to Cobb with a duration of action of 30 seconds (WA $Cobb_{30}$) in accordance with DIN 53132. The results of this measurement are likewise summarised in Table IV

TABLE IV

| Example No. | % amount of cationically modified maize starch | % amount of the reaction product according to Instruction B | WA $Cobb_{30}$ g/m$^2$ |
|---|---|---|---|
| 7a | 0.16 | 0.48 | 33 |
| 7b | 0.80 | 0.48 | 31 |
| (comparison) | 0 | 0.48 | 40 |

EXAMPLE 8

The procedure is carried out as described in Example 7 except that there is added in controlled amounts, instead of the cationically modified maize starch, the amounts, given in the following Table V (as % amounts of an anhydrous product, relative to the dry-fibre content of the fibre suspension), of a potato starch cationically modified with a propylene oxide containing quaternary ammonium groups. Before being used, the cation-active potato starch is hydrolysed and diluted as in Example 7.

TABLE V

| Example No. | % amount of cationically modified potato starch | % amount of reaction product according to Instruction B | WA $Cobb_{30}$ g/m$^2$ |
|---|---|---|---|
| 8a | 0.2 | 0.48 | 29 |
| 8b | 0.4 | 0.48 | 26 |
| (comparison) | 0 | 0.48 | 40 |

EXAMPLE 9

To the fibre suspension according to Example 7, which has however a Schopper-Riegler freeness value of 25° and 45° (instead of 38° ), there is continuously added in measured amounts, at the intervals of time before the fibre suspension reaches the breastbox of the paper machine which are given in the following Table VI, 0.05% (as a % amount of anhydrous product, relative to the solids content of the fibre suspension) of a galactomannan which is cationically modified with 2,3-epoxy-n-propyl-1-trimethylammonium chloride, and which has a substitution degree of 0.10 to 0.15 and a nitrogen content of 1.2 to 1.8%, and which is in the form of a 2% aqueous solution, as component (A), and 0.92% (as % amount of anhydrous product, relative to the solids content of the fibre suspension) of the salt of the epoxide-amine-polyamide reaction product according to manufacturing instruction (B), which is in the form of a 2% aqueous solution, as component (B).

The fibre suspension is then processed as in Example 4 into paper, the WA $Cobb_{30}$ of which is measured. The results of the measurements are likewise summarised in the Table VI which follows.

TABLE VI

| Example No. | Schopper-Riegler freeness value ° | Point of time of the addition of component (A) before fibre suspension reaches breastbox in seconds | Point of time of the addition of component (B) before fibre suspension reaches breastbox in seconds | WA $Cobb_{30}$ g/m² |
|---|---|---|---|---|
| 9a | 25 | 45 | 10 | 27 |
| (comparison) | 25 | — | 10 | 31 |
| 9b | 25 | 57 | 45 | 69 |
| 9c | 25 | 80 | 45 | 58 |
| (comparison) | 25 | — | 45 | 70 |
| 9d | 45 | 60 | 25 | 43 |
| (comparison) | 45 | — | 25 | 45 |
| 9e | 45 | 57 | 45 | 67 |
| 9f | 45 | 80 | 45 | 63 |
| (comparison) | 45 | — | 45 | 71 |

EXAMPLE 10

A fibre suspension of 50% of bleached sulfite pulp from conifers and 50% of bleached sulfate pulp from beechwood is beaten to give a Schopper-Riegler freeness value of 30°. To this fibre suspension are added 5% of precipitated calcium carbonate and 15% of kaolin (as 18% aqueous suspension). The fibre suspension is diluted continuously with water to obtain a dry-fibre content of 0.32%. The pH value of the diluted fibre suspension is 7.5.

There are then continuously added in measured amounts to the fibre suspension, 20 seconds before this reaches the breastbox of the paper machine, 0.1 and 0.2% (as % amount of anhydrous product, relative to the solids content of the fibre suspension) of a condensation product from 1 mol of dicyandiamide, 2.3 mols of formaldehyde and 1.3 mols of ammonium chloride, which product is in the form of a 1% aqueous solution, and, 10 seconds before the fibre suspension reaches the breastbox of the paper machine, 0.3% (as % amount of anhydrous product, relative to the solids content of the fibre suspension) of the salt of the epoxide-amine-polyamide reaction product according to manufacturing instruction A, which is in the form of a 2% aqueous solution.

The fibre suspension is processed in a laboratory paper making machine, at a constant speed, into paper having a weight per unit area of 105 g/m². The paper is subsequently conditioned in the manner described in Example 1, and then tested with respect to its IFT and, as given in Example 4, its WA $Cobb_{30}$, and the results of these tests are summarised in the Table VII which follows.

TABLE VII

| Example No. | % amount of condensation product from dicyandiamide, formaldehyde and ammonium chloride | % amount of the reaction product according to Instruction (A) | WA $Cobb_{30}$ g/m² | IFT sec. |
|---|---|---|---|---|
| 10a | 0.1 | 0.3 | 43 | 900 |
| 10b | 0.2 | 0.3 | 38 | 1050 |
| (comparison) | 0 | 0.3 | 61 | 600 |

EXAMPLE 11

Fibre suspensions of 50% of bleached sulfite pulp from the wood of conifers and 50% of bleached sulfate pulp from beechwood are ground to give a Schopper-Riegler freeness value of 25° and 45°, and in a mixing vat is added 16% of precipitated calcium carbonate as a 30% aqueous suspension. The fibre suspensions are diluted in each case with water to obtain a dry-fibre content of 0.4%. The diluted fibre suspensions have a pH value of 7.8.

To the fibre suspensions is then added in measured amounts, 12 and 35 seconds respectively before the breastbox of the paper machine is reached, 0.3% (% amount of anhydrous product, relative to the solids content of the fibre suspension) of a potato starch cationically modified with a propylene oxide containing quaternary ammonium groups. Before being used, the cationic potato starch is hydrolysed with water at 90° to 96° C. for 20 to 30 minutes, and then diluted with water at 90° C. to give a 1% aqueous solution. Ten seconds before the fibre suspension reaches the breastbox of the paper machine, there is added continuously in measured amounts also 0.42% (% amount of anhydrous product, relative to the solids content of the fibre suspensions) of the salt of the epoxide-polyamide-reaction product according to manufacturing instruction C, in the form of a 2% aqueous solution.

Each fibre suspension is processed in a laboratory paper machine, with a constant machine output, into a paper having a weight per unit area at 85 g/m². The paper is conditioned in the manner described in Example 4, and then tested with respect to its WA $Cobb_{30}$, and the results of the tests are summarised in the Table VIII which follows.

TABLE VIII

| Example No. | Schopper-Riegler freeness value ° | Cationically modified potato starch | | Salt of the reaction product according to Instruction C | | WA $Cobb_{30}$ g/m² |
|---|---|---|---|---|---|---|
| | | % addition | sec. before reaching breastbox | % addition | sec. before reaching breastbox | |
| 11a | 25 | 0.30 | 12 | 0.42 | 10 | 30 |
| 11b | 25 | 0.30 | 35 | 0.42 | 10 | 28 |

TABLE VIII-continued

| Example No. | Schopper-Riegler freeness value ° | Cationically modified potato starch % addition | Cationically modified potato starch sec. before reaching breastbox | Salt of the reaction product according to Instruction C % addition | Salt of the reaction product according to Instruction C sec. before reaching breastbox | WA Cobb30 g/m2 |
|---|---|---|---|---|---|---|
| (comparison) | 25 | 0 | — | 0.42 | 10 | 43 |
| 11c | 45 | 0.30 | 12 | 0.42 | 10 | 24 |
| 11d | 45 | 0.30 | 35 | 0.42 | 10 | 23 |
| (comparison) | 45 | 0 | — | 0.42 | 10 | 29 |

EXAMPLE 12

The process is carried out in the manner described in Example 11 except that to the fibre suspension, which has a Schopper-Riegel freeness value of 25°, is added, instead of 0.3% of the cationically modified potato starch, 0.3% of an aqueous solution of a high-molecular cationic polyacrylic amide of which the density is about 1000 kg/m$^3$, dynamic viscosity at 20° C. is 5000 to 7000 mPa.s (Brookfield, spindle 4, 20 rpm), and the pH value is 4. Before being used, this solution is pre-diluted with water to give the 10-fold amount.

The resultant WA Cobb$_{30}$ values for the paper produced in the manner given in Example 11 are summarised in the Table IX which follows.

TABLE IX

| Example No. | Schopper-Riegler freeness value ° | Cationic polyamide % addition | Cationic polyamide seconds before reaching breastbox | Salt of the reaction product according to Instruction C % addition | Salt of the reaction product according to Instruction C seconds before reaching breastbox | WA Cobb30 g/m2 |
|---|---|---|---|---|---|---|
| 12a | 25 | 0.30 | 12 | 0.42 | 10 | 40 |
| 12b | 25 | 0.30 | 35 | 0.42 | 10 | 33 |
| (comparison) | 25 | 0 | — | 0.42 | 10 | 43 |

We claim:

1. A process for producing paper or cardboard, sized in the pulp, on a paper machine, with an epoxide-amine-polyamide reaction product, comprising the steps of adding to the pulp fiber suspension, which has a pH value of 5 to 8, (A) a water-soluble high molecular weight polyelectrolyte, which is cationic if the pH value of the fiber suspension is 6.5 to 8 and anionic if the pH value of the fiber suspension is 5 to 7, followed by (B) A water-soluble or water-dispersible salt of an epoxide-amine-polyamide reaction product;

wherein the cationic polyelectrolyte is selected from the group consisting of a cationically modified starch; cationically modified carbohydrates from guar flour or locust bean flour having molecular weights of 250,000 to 350,000; a cationally modified alginic acid having a degree of polymerization of 800 to 1200; a condensation product from dicyandiamide or cyanamide, formaldehyde and an ammonium halide; a cationic polyacrylic amide; an epichlorohydrin adduct of a reaction product from a polyalkylenepolyamine and an aliphatic dicarboxylic acid; an epichlorohydrin adduct of a reaction product from a polyalkylenepolyamine and dicyandiamide or cyanamide; and an epichlorohydrin adduct of a reaction product from a polyalkylenepolyamine, dicyandiamide or cyanamide, and an aliphatic dicarboxylic acid which is unesterified or esterified with alkanols;

wherein the anionic polyelectrolyte is selected from the group consisting of a dimerized condensation product from a naphthalenesulphonic acid and formaldehyde; a copolymer from acrylic acid and acrylic amide; or an alkali metal salt or ammonium salt of alginic acid, having a degree of polymerization of 800 to 1200;

wherein component (B) is a salt of the reaction product from (a) 1.0 epoxide group equivalent of a polyglycidyl ether of 2,2-bis(4'-hydroxyphenyl)-propane, (b) 0.4 to 0.6 amino group equivalent of a mono-fatty amine having 16 to 18 carbon atoms, and (c) 0.3 to 0.5 amino group equivalent of a polyalkeneaminopolyamide from (c') polymerised linoleic or linolenic acid, and (c'') diethylenetriamine, triethylenetetramine or tetraethylenepentamine, in the form of an aqueous preparation having a solids content of 25 to 35 percent by weight and a pH value of 4 to 5;

wherein component (A) is added in an amount which is 0.01 to 1 percent by weight, relative to the dry-fiber content of the fiber suspension;

wherein component (B) is added in an amount which is 0.1 to 3 percent by weight, relative to the dry-fiber content of the fiber suspension;

and wherein component (A) is added 8 to 80 seconds before the fiber suspension reaches the breastbox of the paper machine, and component (B) 3 to 50 seconds before the fiber suspension reaches the breastbox, however at least 5 seconds after the addition of component (A).

2. A process according to claim 1, in which there is added as component (A) at a pH value of the fiber suspension of 6.5 to 8: a condensation product from dicyanamide, formaldehyde and ammonium chloride; a cationic polyacrylic amide, having a density of about 100 kg/m$^3$ and a dynamic viscosity at 20° C. of 5000 to 7000 mPa.s (Brookfield spindle 4, 20 rpm); a cationically modified galactomannan from guar flour having a substitution degree of 0.10 to 0.15; or a maize starch or potato starch cationically modified with a propylene oxide containing quaternary ammonium groups.

3. A process according to claim 1, in which the pH value of the fiber suspension is adjusted to 5 to less than 7 with aluminium sulfate.

4. A process according to claim 1, in which there is added as component (B) an aqueous preparation of a salt of an epoxide-amine-polyamide reaction product, which is produced in a water-soluble aliphatic alcohol or ether having 1 to 10 carbon atoms, as an inert solvent from a polyglycidyl ether having an epoxide content of 5 to 5.5 equivalents per kilogram as component (a), and a mono-fatty amine and a polyalkyleneaminopolyamide each having an amino group content of 3 to 4 amino group equivalents per kilogram as components (b) and (c), respectively, the pH value of this preparation being adjusted to 4 to 5 by means of an alkanecarboxylic acid having 1 to 3 carbon atoms.

5. A process according to claim 1, in which the fiber suspension has a Schopper-Riegler freeness value of 20° to 45°.

6. A process according to claim 1, in which the pH value of the fiber suspension is adjusted with kaolin to 5 to 7, or with calcium carbonate to 7 to 8.

7. A process according to claim 1, in which the fiber suspension contains sulfite pulp from the wood of conifers, sulfate pulp from beechwood and mechanical wood pulp.

8. A process according to claim 1, in which the fiber suspension contains sulfite pulp from the wood of conifers and sulfate pulp from beechwood.

* * * * *